US005137546A

United States Patent [19]

Steinbacher et al.

[11] Patent Number: 5,137,546

[45] Date of Patent: Aug. 11, 1992

[54] PROCESS AND APPARATUS FOR ELECTROSTATIC PURIFICATION OF DUST- AND POLLUTANT-CONTAINING EXHAUST GASES IN MULTIPLE-FIELD PRECIPITATORS

[75] Inventors: Karl Steinbacher, Mühlheim; Hermann Schmidt, Bad Vilbel; Wilhelm Leussler, Frankfurt am Main, all of Fed. Rep. of Germany

[73] Assignee: Metallgesellschaft Aktiengesellschaft, Frankfurt am Main, Fed. Rep. of Germany

[21] Appl. No.: 578,021

[22] Filed: Aug. 31, 1990

[30] Foreign Application Priority Data

Aug. 31, 1989 [DE] Fed. Rep. of Germany ..... 3928080
Feb. 2, 1990 [DE] Fed. Rep. of Germany ..... 4004357
Jul. 26, 1990 [DE] Fed. Rep. of Germany ..... 4023723

[51] Int. Cl.[5] ..... B03C 3/00

[52] U.S. Cl. ..... 55/10; 55/12; 55/112; 55/122; 55/151; 55/154; 55/118

[58] Field of Search ..... 55/2, 10, 12, 13, 108, 55/112, 118–120, 122, 136, 154, 151

[56] References Cited

U.S. PATENT DOCUMENTS 1,766,422 6/1930 Wintermute ..... 55/118
3,248,857 5/1966 Weindel ..... 55/118
4,181,509 1/1980 Honacher et al. ..... 55/154
4,189,308 2/1980 Feldman ..... 55/13
4,360,366 11/1982 Collins ..... 55/119
4,441,897 4/1984 Young et al. ..... 55/112

FOREIGN PATENT DOCUMENTS 565152 10/1933 Fed. Rep. of Germany ..... 55/136
61946 5/1980 Japan ..... 55/10
362682 8/1962 Switzerland .
806069 2/1981 U.S.S.R. ..... 55/119
988350 4/1965 United Kingdom .

OTHER PUBLICATIONS

Metallgesellschaft AG, Abtrag-und Abtropfvorrichtung für Sprüh-Electrodenrahmen Apr. 21, 1964.

*Primary Examiner*—Bernard Nozick
*Attorney, Agent, or Firm*—Michael J. Striker

[57] ABSTRACT

A process and an apparatus for the electrostatic purification of dust- and pollutant-containing exhaust gases in multiple-field precipitators are proposed. The exhaust gases are first subjected in a first stage to an electrostatic purification under dry conditions in gas passages defined by platelike collecting electrodes and are subsequently passed in a second stage through one or more fields defined by liquid-wetted collecting electrodes, which define gas passages. The liquid which is supplied in the second stage at the top ends of the collecting electrodes is laterally discharged from the precipitator and the substantially dry dust which is still collected in the second stage is fed to dust-receiving means.

27 Claims, 6 Drawing Sheets

(A-A)

(B-B)

PROCESS AND APPARATUS FOR ELECTROSTATIC PURIFICATION OF DUST- AND POLLUTANT-CONTAINING EXHAUST GASES IN MULTIPLE-FIELD PRECIPITATORS

BACKGROUND OF THE INVENTION

This invention relates to a process for the electrostatic purification of dust- and pollutant-containing exhaust gases in multiple-field precipitators, in which the exhaust gases are first subjected in a first stage in the direction of flow to an electrostatic purification under dry conditions in gas passages defined by platelike collecting electrodes and are subsequently passed in a second stage through one or more fields which are defined by liquid-wetted collecting electrodes, which define gas passages. The invention relates also to an apparatus for carrying out the process.

In known processes for electrostatic purification of dust- and pollutant-containing exhaust gases the latter are subjected to an electrostatic purification under dry conditions in a first processing stage and in a succeeding second processing stage are subjected to an electrostatic purification under wet conditions. British Patent Specification 988,350 describes an electric dedusting process in which a drying tower, one or more electric fields operating under dry conditions, and one or more electric fields operating under wet conditions are arranged in succession. The water is sprayed through nozzles into the wet field or fields and is drained as a slurry, which is concentrated in thickeners and is then injected by means of steam or compressed air into the drying tower, in which the evaporated liquid humidifies the hot drying gas so that a back corona discharge in the fields operating under dry conditions is prevented. From the article "Hybrid-type electrostatic precipitator" by Masuda, Air Pollut, Control Assoc. 1977, 27(3), 241-1 (Eng.) it is apparent that in such process acid components such as $SO_x$, HF and HCL, are absorbed from the liquid which has been sprayed into the wet stage and together with the dust which is still collected in the wet stage enter a sump disposed in the wet stage. A disadvantage of that process resides in that the slide formed in the sump of the wet stage contains a relatively large amount of pollutants in addition to the dust and for this reason can be processed only with difficulty. A further disadvantage of that process resides in that the evaporated liquid which has been injected into the drying tower will moisten the dust-and pollutant-containing exhaust gas so that its dew point temperature will be increased. Because the gas temperature is decreased at the same time, the temperature in the electrostatic precipitator will decrease below the dew point temperature so that a corrosion caused by the acid components of the exhaust gas cannot be avoided.

U.S. Pat. No. 1,766,422 also describes the electrostatic purification of dust- and pollutant-containing exhaust gases in a process in which the exhaust gas laden with dust and pollutants is first subjected to an electrostatic purification under dry conditions and subsequently to an electrostatic purification under wet conditions. In that process that collecting electrodes of the wet electrostatic purification stage are wetted with a treating liquid. The electrostatic precipitator is operated at such a high gas velocity that the particles of the fine fraction will be collected in the dry electrostatic purification stage and those of the coarse fraction in the wet electrostatic purification stage. In that process, the sludge formed in the sump of the wet electrostatic purification stage and will contain a relatively large amount of pollutants in addition to the dust. An additional disadvantage of that process resides in that the exhaust gas is passed through the electrostatic precipitator at a relatively high gas velocity to ensure that the coarse particles of the dust contained in the exhaust gas can be collected in the wet electrostatic purification stage. As a result, the residence time of the exhaust gas in the wet electrostatic purification stage is not sufficient to ensure that the pollutants contained in the exhaust gas will be removed to such a degree that the limits prescribed in TA-Luft (German Regulation for Air Pollution Control) dated Feb. 27, 1986, can be complied with.

SUMMARY OF THE INVENTION

It is therefore an object of the invention to provide for the electrostatic purification of dust- and pollutant-containing exhaust gases in multiple-field precipitators a process by which the above-mentioned disadvantages will be avoided and which permits a separate collection of dry dust, on the one hand, and of pollutants, on the other hand, and in which pollutants contained in the exhaust gas are collected in a substantially dust-free state in the wet electrostatic purification stage.

The object underlying the invention is accomplished in that the liquid which is supplied in the second stage at the top ends of the collecting electrodes is collected under the lower ends of the collecting electrodes and is laterally discharged from the precipitator and the substantially dry dust which is still collected in the second stage is fed to dust-receiving means. The term "dust" is applicable to the solid particles contained in the exhaust gas. For instance, in the exhaust gas from sintering plants the dust consists mainly of solid particles which contain iron oxide, and the dust in the exhaust gas from furnaces consists of the small particles of fly ash. The term "pollutants" is applicable to the acid components, such as HF, $SO_2$, $SO_3$ and HCl, which are contained in the exhaust gas, and to the non-ferrous metals, such as Pb, Cd, Hg and As, which are contained in the form of vapor or gas or in a sublimated form in the exhaust gas. Each of the first and second stages of the multiple-field precipitator which is employed contains at least one electrostatic field. If the exhaust gas rate amounts to 100,000 $m^3/h$, the field strength will be 1.5 to 2.5 kV/cm and the total collecting surface area of the multiple-field precipitator will be in the range from 400 to 700 $m^2$. The platelike collecting electrodes may consist of metal plates, metal nets, plastic woven fabrics or plates of ceramic materials. The liquid which is fed to the second stage at the top ends of the collecting electrodes consists of an aqueous solution. The dust-receiving means may consist of any of various devices, such as conveyor screws.

A very large part of the dust that is collected in the first stage is dry and even the dust which has entered the second stage can be collected in a dry state to a substantial degree and can thus be separated from the pollutants. This is accomplished in that in the second stage only the collecting electrodes are wetted and the liquid which has been sprayed is drained in collecting troughs closely below the collecting electrodes whereas the gas passage space proper and the space below the electrodes remain dry. As a result, only a very small part of the dust will enter the liquid.

An advantage afforded by the process resides in that the pollutants contained in the exhaust gas are not mixed in the second stage with the substantially dry dust which is also collected in the second stage and are not discharged from the precipitator together with that dust. As a result, no sludge which is laden with pollutants and can be disposed of only with difficulty will be collected in the second stage. That process permits also a decrease of the dust resistivity to such a low value that a back corona discharge will be avoided and dust and pollutants will be collected in such a manner that their residual contents will be much lower than the limits prescribed for pollutant concentrations in the pure gas.

In accordance with a preferred feature of the invention the residence time of the gases in the second stage amounts to 60 to 80% of the entire residence time in a multiple-field separator. As a result, the gas temperature in the second stage is decreased only to the extent of the temperature difference by which the gas temperature is raised as a result of the compression of gas in the succeeding fan. Besides, the dew point temperature of the water is increased only by about 4° C. As a result, the selected difference between the gas temperature and the dew point temperature of the water in the second stage of the multiple-field separator is so high that the temperature will not decrease below the dew point temperature of the water and, as a result, there will be no condensation of the acid pollutants on the non-wetted dry portions of the second stage. As a result, there is no need for special measures for avoiding a corrosion in the second stage. The division of the residence time in accordance with the invention permits also a collection of the particles of the coarse fraction of the dust in the first stage and a collection of the particles of the fine fraction of the dust in the second stage. For this reason the process can successfully be carried out at relatively low gas velocities and the residence time in the second stage is sufficient for removal of the pollutants from the exhaust gas to an adequate degree.

In accordance with a further preferred feature of the invention the liquid which is employed consists of an alkaline aqueous solution having a pH-value from 7 to 9. If such an alkaline aqueous solution is employed, the acid pollutants will be bound to a relatively high degree so that the pure gas discharged from the second stage is almost free of acid pollutants.

In accordance with a further preferred feature of the invention, NaOH and/or KOH and/or $Ca(OH)_2$ is added to the liquid. Said substances are easily soluble in water so that the aqueous solution can be adjusted quickly and without difficulty to a pH value in the range from 7 to 9.

In accordance with a further preferred feature of the invention a pulsed voltage having a pulse width in the range from 20 to 400 ms is applied to the collecting electrodes. In contrast to the normal mode of operation of an electrostatic precipitator, that measure has the result that d.c. voltage pulses are applied to the corona discharge electrode only at such a rate that charge carriers for the collection of the dust contained in the raw gas stream will be produced just at a sufficiently high rate. Thereafter, the thyristor will be blocked for an interval of 20 to 400 ms and the voltage applied to the precipitator will exponentially be decreased until the next d.c. voltage pulses are applied. Between consecutive d.c. voltage pulses the voltage applied to the precipitator will be kept at an optimum lower limit so that an excessive decrease of the voltage applied to the precipitator and of the driving force for imparting a migrating movement to the charged dust particles to the collecting electrode will be avoided. If a pulsed voltage having a pulse width in the range from 20 to 400 ms is applied to the collecting electrodes, dust will be collected to a high degree even in the first stage of the multiple-field precipitator. That measure will also ensure that the coarses fraction of the dust can already be collected in the first stage of the multiple-field precipitator.

In accordance with a further preferred feature of the invention the dead space existing in the second stage between the collecting electrodes and the housing wall of the precipitator is purged with hot gas, which enters the dead space through nozzles. As a result, a condensation of the water vapor contained in the exhaust gas on the walls of the second stage at temperatures below the dew point temperatures and a resulting corrosion of the structural parts of the second stage can be avoided.

In accordance with a further preferred feature of the invention part of the pure gas which has been discharged from the second stage is used as a hot gas. As a result, no pollutants will be returned to the second stage of the multiple-field precipitator as a result of the purging of the dead space. The pure gas which is injected is substantially free of pollutants so that a corrosion particularly on the walls of the housing of the multiple-field precipitator will be almost entirely avoided.

In accordance with a further preferred feature of the invention the corona discharge system and/or the housing wall of the second stage is rapped. The corona discharge system of the second stage consists of all corona electrodes of the wet electrostatic purification stage and of the hanger means for said electrodes. Surprisingly it has been found that a major part of the dust which has been raised by rapping is not deposited on the collecting electrodes wetted with liquid but partly in an agglomerated form falls down in the dry space of the gas passages or directly along the housing walls of the second stage and thus enters directly the dust-receiving means. As a result, the dust which has been raised by the rapping in the second stage can be removed in a substantially dry state and can thus be separated from the gaseous pollutants. The process in accordance with the invention is not restricted to the use of specific rapping means.

In accordance with a further feature of the invention the corona discharge system is rapped once in intervals of from 2 to 20 minutes. The term "minutes" is applicable to the minutes of the time for which the second stage is operated. If the corona discharge system, is rapped once in each interval of from 2 to 20 minutes, the corona discharge system will thoroughly be cleaned whereas the electrostatic purification process proper which is carried out in the second stage will not adversely be affected.

In accordance with a further feature of the invention the individual corona electrodes or the individual hangers of the corona discharge system of a gas passage are consecutively rapped. This will afford the advantage that a strong raising of dust and temporarily increased dust concentrations in the pure gas will reliably be avoided.

In accordance with a further feature of the invention the housing wall of the second stage is rapped once in each interval from 2 to 120 minutes. The term "minutes" is applicable to the minutes of the time for which the second stage is operated. As a result, dust is thoroughly removed from the housing wall during the operation whereas the electrostatic purification process in the second stage will not adversely be affected.

The object underlying the invention is also accomplished by the provision of an apparatus in which the collecting surface area of the collecting electrodes of the second stage amounts to 20 to 45% of the total collecting surface area of the precipitator. As a result, substantially all dust and pollutants can be removed from the exhaust gas even at low gas velocities so that the concentrations of dust and pollutants in the pure gas can be kept relatively far below the prescribed limits.

In accordance with a further feature of the invention an overflow trough is provided at the top end of each collecting electrode of the second stage, a collecting trough is provided at the bottom end of each collecting electrode of the second stage, and each collecting electrode of the second stage is secured to the bottom end of the associated overflow trough. As a result, the collecting electrode will uniformly be wetted and it is ensured that the liquid laden with the pollutants can be collected in a relatively dustfree state closely under the bottom ends of the collecting electrodes and can subsequently be discharged. The collecting troughs are so dimensioned that they can conduct the entire liquid, which is usually collected at a rate from 40 to 80 $m^3/h$ if exhaust gas is processed at a rate of 100,000 $m^3/h$. The overflow troughs are so dimensioned that the collecting electrodes will uniformly be wetted with a liquid film. If each collecting electrode of the second stage is secured to the bottom end of the associated overflow trough, the collecting electrode will uniformly be wetted from their top end.

In accordance with a further preferred feature of the invention at least one edge of each overflow trough is comblike. As a result, the collecting electrodes will uniformly be wetted with a liquid film and the thickness of the liquid film on the collecting surface of each collecting electrode will be approximately constant. This permits a removal of pollutants in the second stage to a uniform degree, almost the entire collecting surface area of each collecting electrode of the second stage is available for the collection of pollutants, and an overdimensioning of the collecting surfaces of each collecting electrode is not required.

In accordance with a further preferred feature of the invention, each overflow trough contains a liquid distributing pipe, which is formed with openings and connected to the liquid feeder. In such an arrangement, liquid can be fed to each overflow trough directly from above. In such an arrangement the liquid may also be circulated.

In accordance with a further preferred feature of the invention each overflow trough is connected to the associated liquid distributing pipe. As a result, each collecting electrode is directly connected to the associated liquid distributing pipe by the associated overflow trough so that the access to the collecting electrode will be facilitated for repairs.

In accordance with a further feature of the invention a pipe is provided at the top end of each collecting electrode of the second stage and is directly joined to the collecting electrode and on that side which faces away from the collecting electrode has bores, which are disposed in the plane of the collecting electrode, said pipe communicates with the source of liquid and collecting troughs are provided at the bottom ends of respective collecting electrodes of the second stage. The pipe may be joined to the collecting electrode, e.g. by welding, by an adhesive joint, or by a screw or rivet joint. Surprisingly it has been found that a discharge of liquid from the bores will not result in a formation of crystals so that a uniform flow of liquid on the collecting electrodes will be ensured for a long operating time. In the apparatus in accordance with the invention the thickness of the film formed by the liquid can be optimized by a change of the rate at which the liquid is supplied. It may also be desirable to vary the rate of flow of the liquid in a predetermined cycle during a continuous supply of liquid.

In accordance with a further feature of the invention the bores are 8 to 12 mm in diameter. This will result in a particularly uniform distribution of the liquid on a given collecting electrode.

In accordance with a further feature of the invention the bores are spaced 20 to 40 mm apart. With that spacing the thickness of the layer of liquid on the collecting electrodes can particularly effectively be adjusted because a liquid film having a constant thickness will already be formed on the outside surface of the pipe.

In accordance with a further feature of the invention the pipe is from 60 to 140 mm in diameter. This will afford the advantage that with such pipe the liquid can easily be applied to the collecting electrodes at the usual flow rates amounting, as a rule, to between 40 and 80 $m^3/h$. If the pipe is from 60 to 140mm in diameter, it can be used for a multitude of purposes so that the costs of the apparatus in accordance with the invention can be reduced in that the pipe is mass-produced.

In accordance with a further feature of the invention the pipe is additionally connected to the collecting electrode by at least one plate, which extends in the longitudinal direction of the pipe. In that case the film of liquid will not be broken between the bores of the pipe and the collecting electrode and the connection between the pipe and the collecting electrode will be reinforced. The plate may be joined to the pipe and to the collecting electrode, e.g., by welding, by an adhesive joint, or by a screw or rivet joint.

In accordance with a further feature of the invention at least one plate is joined to the pipe at an edge portion which is tangential to the pipe. This will ensure a smooth flow of the film of liquid from the pipe to the plate.

Accordance with a further feature of the invention, a hot gas feeder is provided in the second stage. The hot gas feeder in the second stage permits the dead space between the collecting electrodes and the housing wall of the precipitator in the second stage to be purged with hot gas.

In accordance with a further feature of the invention the edges of each collecting electrode of the second stage are connected to a pipe, which is connected to the liquid feeder. This will afford the advantage that the liquid can directly be fed to each overflow trough and each of the gas passages between the collecting electrodes can be kept free for the passage of gas so that the collecting operation in the second stage of the multiple-field precipitator will not adversely be affected.

In accordance with a further preferred feature of the invention, openings are formed in the pipe provided at the bottom edge of each collecting electrode of the second stage. This will result in the advantage that liquid is directly injected also into the collecting troughs so that the latter will be cleaned as the process is carried out and a discharge of the pollutant-laden liquid from the collecting troughs will be ensured. The openings are so designed that the liquid may be circulated and nevertheless a clogging of the openings by liquid which has been laden will be avoided. A copending application Ser. No. 710,354 was filed on Mar. 31, 1991.

The subject matter of the invention will now be explained more in detail with reference to the drawings.

DESCRIPTION OF THE PREFERRED EMBODIMENTS

Figure 1:
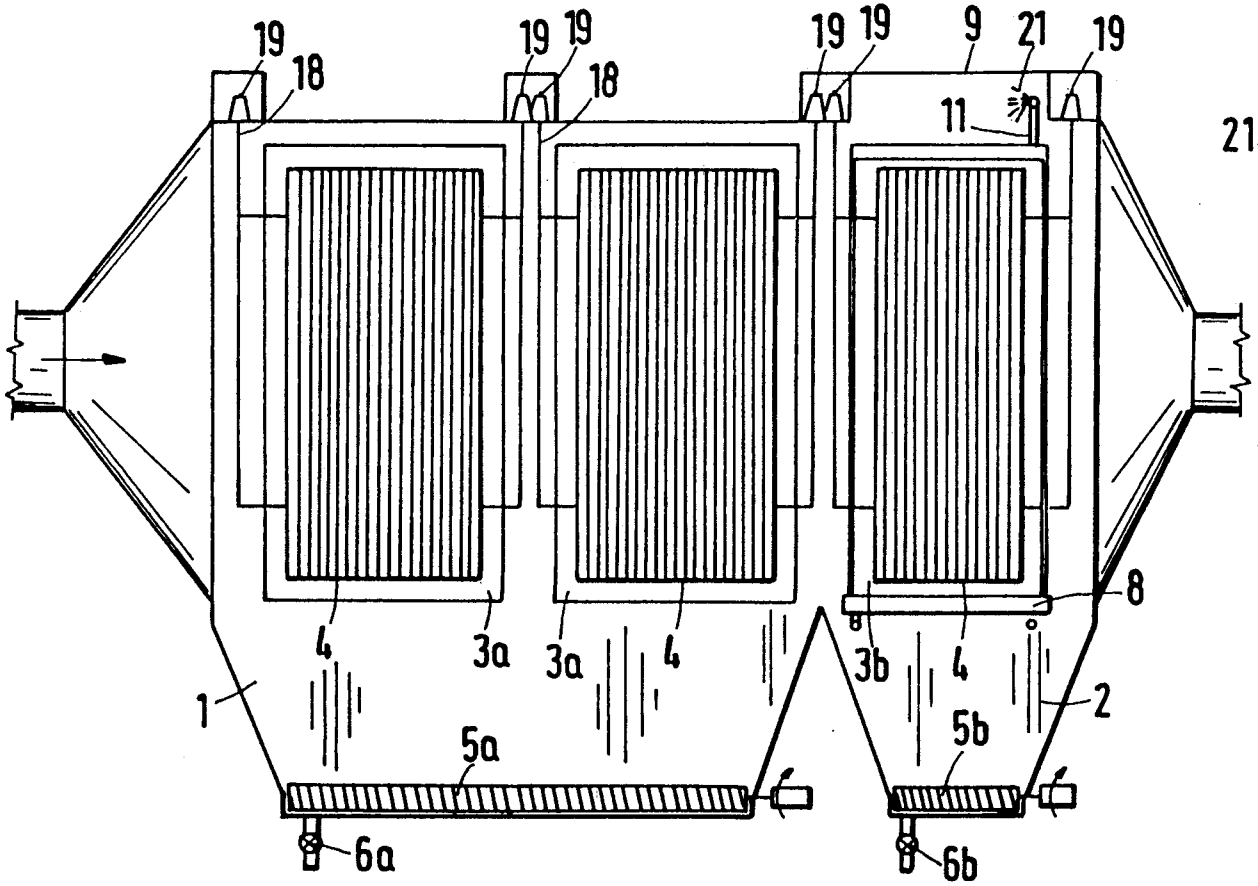
FIG. 1 is a longitudinal sectional view showing the multiple-field precipitator comprising three separate electric fields. The third field viewed in the direction of the arrow is provided with wetted collecting electrodes and is operated as the second stage.

FIG. 1 is a longitudinal sectional view showing the multiple-field precipitator. The exhaust gas laden with dust and pollutants enters in the direction indicated by the arrow the first stage 1 and is electrostatically purified therein under dry conditions. The first stage 1 contains collecting electrodes 3*a* operated in a dry state and corona electrodes 4. Said electrodes are held by hanger means 18 and electrically insulated by pin insulators 19. In the first stage 1 the collecting electrodes 3*a* which are operated in a dry state are cleaned in that they are periodically rapped during operation. For the discharge of the dry dust which has been collected, the first stage 1 comprises dust-receiving means 5*a* and discharge means 6*a*. Immediately after the electrostatic purification effected under dry conditions the exhaust gas enters the second stage 2, which contains liquid wetted collecting electrodes 3*b* and corona electrodes 4. Just as in the first stage 1 the collecting electrodes 3*b* and the corona electrodes 4 are electrically insulated by pin insulators 19. The pollutant-laden liquid runs down on the collecting surface of each collecting electrode and enters the associated collecting trough 8. Dust-receiving means 5*b* and discharge means 6*a* are provided for removing the dry dust which has been collected in the second stage. The second stage 2 of the multiple-field precipitator contains a hot gas feeder 11, which has nozzles, through which hot gas enters the dead spaces between the collecting electrodes 3*b* and the housing wall 9 of the precipitator. The pure gas leaves the second stage 2 of the multiple-field precipitator in the direction indicated by the arrow.

Figure 2:
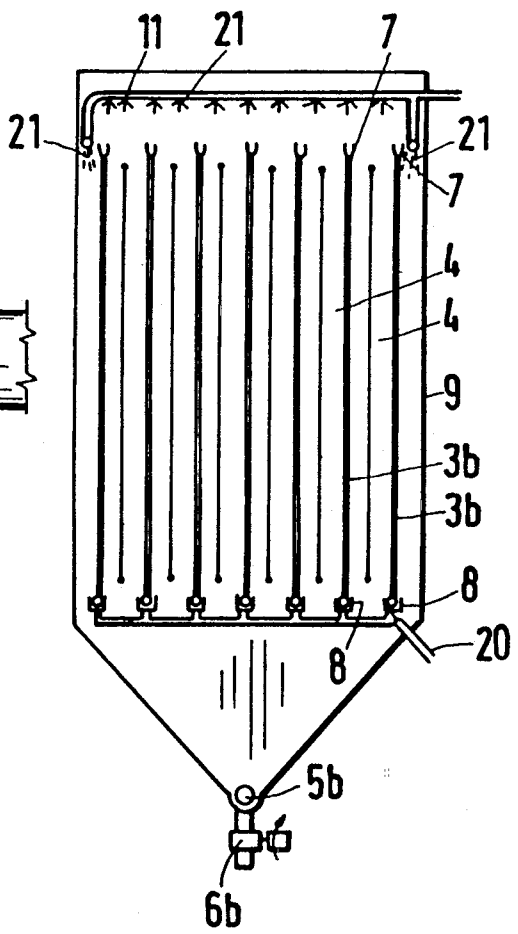
FIG. 2 is a transverse sectional view showing the second stage of the multiple-field precipitator.

FIG. 2 is a transverse sectional view showing the second stage 2 of the multiple-field precipitator with the collecting electrodes 3*b*, the corona electrodes 4, the overflow troughs 7, the collecting troughs 8 and the hot gas feeder 11. In accordance with FIG. 2 the dust-receiving means 5*b* consist of a discharge screw, by which the dry dust which has been collected in the second 2 is forwarded to discharge means 6*b*. The pollutant-laden liquid which has been collected in the collecting troughs 8 is laterally discharged through a drain 20, by which the laden liquid, which contains dissolved salts, may be fed to a succeeding crystallizing plant, in which the dissolved salts are recovered as solids.

Figure 3:
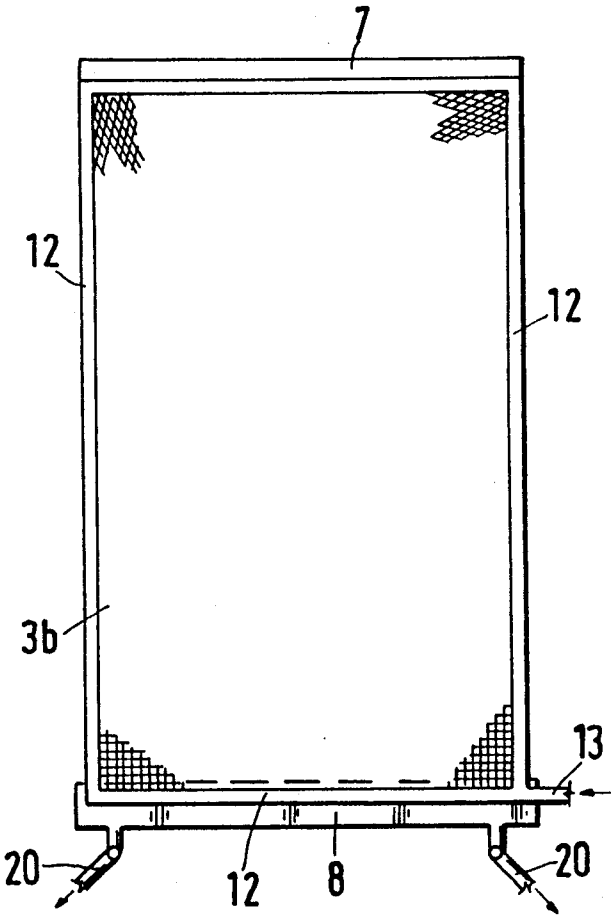
FIG. 3 shows a collecting electrode, which at its edges is connected to a pipe and which is provided with a liquid feeder and a collecting trough.

FIG. 3 shows a wetted collecting electrode 3*b*, which is provided with a liquid feeder 13 and the collecting trough 8. From the liquid feeder 13 the liquid flows through the pipe 12 to the overflow trough 7 and further over the collecting surfaces of the collecting electrode into the collecting trough 8. The laden liquid is discharged through the drain 20.

Figure 4:
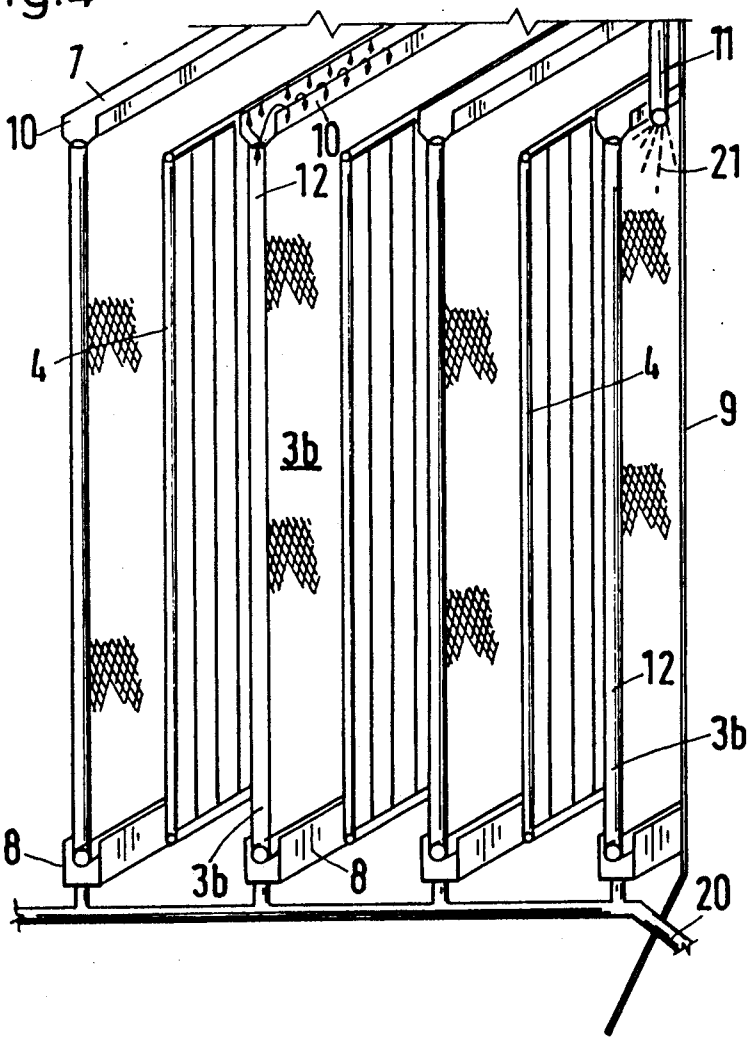
FIG. 4 is a fragmentary perspective view showing some gas passages of the second stage of the multiple-field precipitator.

FIG. 4 is a fragmentary perspective view showing some gas passages between the collecting electrodes 3*b*, which are provided with a hot gas feeder 11, overflow troughs 7 and collecting troughs 8. The liquid is fed to each overflow trough 7 by the pipe 12 and flows over the edges 10 of the overflow trough 7 onto the collecting electrode 3*b*. Hot gas 21 is injected from the hot gas feeder 11 into the dead space between the collecting electrode 3*b* and the housing wall 9 of the precipitator.

Figure 7:
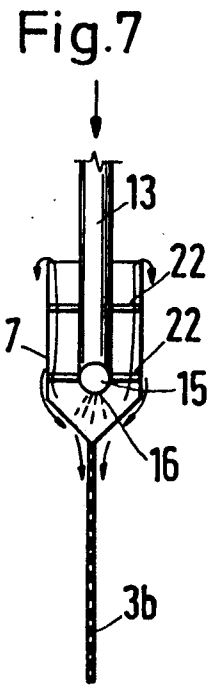
FIG. 7 is a transverse sectional view showing the upper portion of a wetted collecting electrode provided with an overflow trough, a liquid distributing pipe and a liquid feeder.
Figure 6:
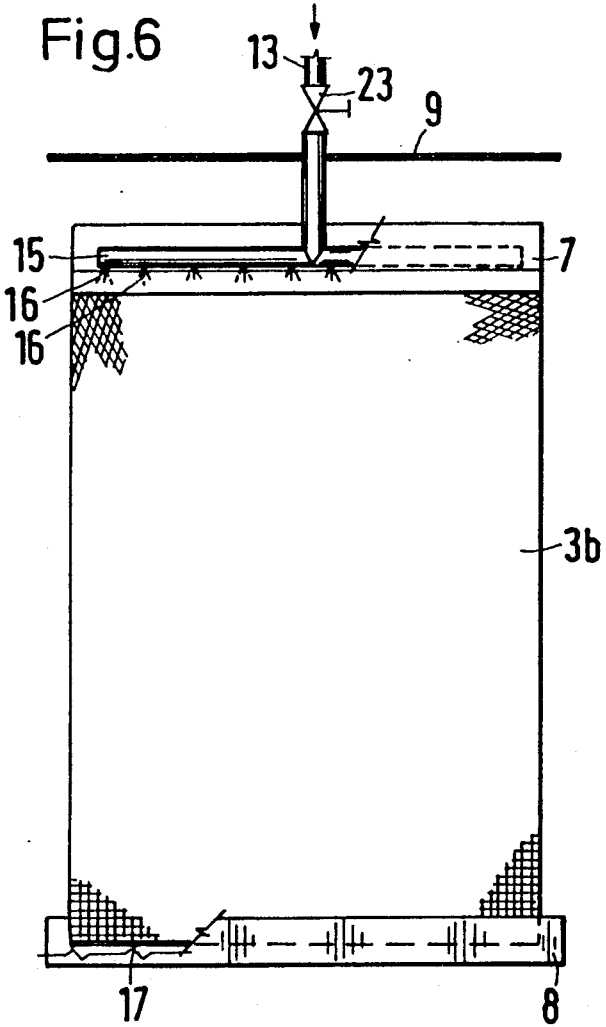
FIG. 6 is a side elevation showing the collecting electrode of FIG. 5.
Figure 5:
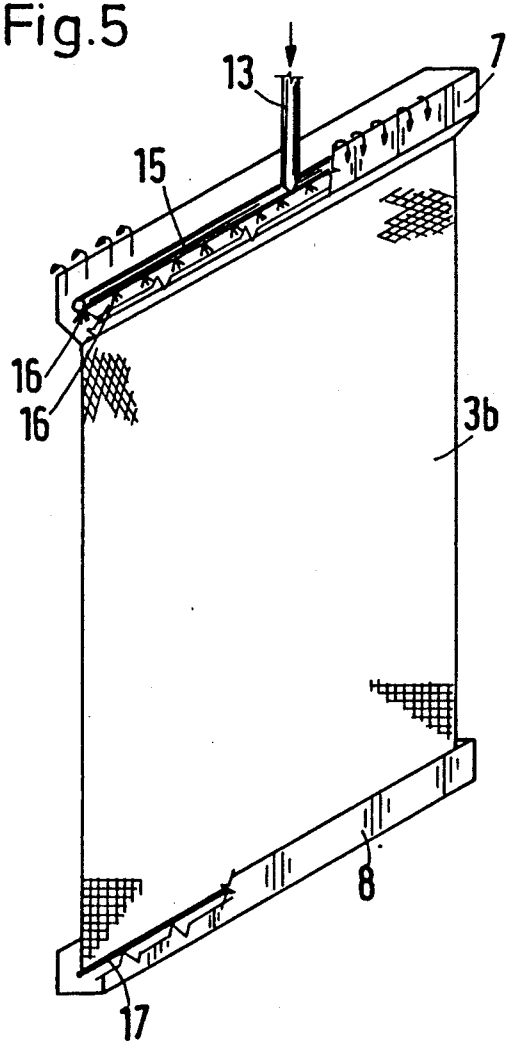
FIG. 5 is a perspective view showing a wetted collecting electrode provided with the overflow trough and with the liquid distributing pipe, which is formed with openings and communicates with the liquid feeder.

FIGS. 5, 6 and 7 show a collecting electrode 3*b*, which is provided with an overflow trough 7 and a collecting trough 8. The liquid is supplied to the overflow trough 7 through a liquid distributing pipe 15, which is formed with openings 16 and connected to the liquid feeder 13. The collecting electrode 3*b* is biased by a weight 17 so that it can be fixed in a central position in the collecting trough 8. In accordance with FIG. 6, the liquid feeder 13 contains outside the housing wall 9 of the precipitator a valve 23 for an accurate adjustment of the rate of liquid. As is shown in FIG. 7 the liquid feeder 13 and the liquid distributing pipe 15 are connected to the overflow trough 7 by webs 22 so that the electrode 3*b* can be directly held by the overflow trough 7 on the liquid distributing pipe 15 and the liquid feeder 13.

Figure 8A:
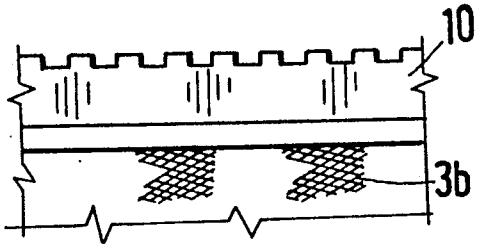
FIGS. 8*a*, 8*b*, 8*c* show various embodiments of the overflow edges of the overflow troughs.
Figure 8B:
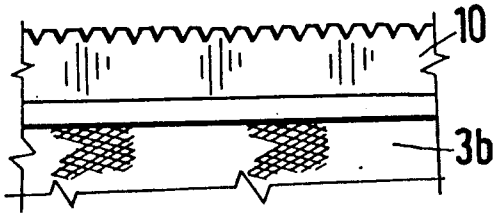
Figure 8C:
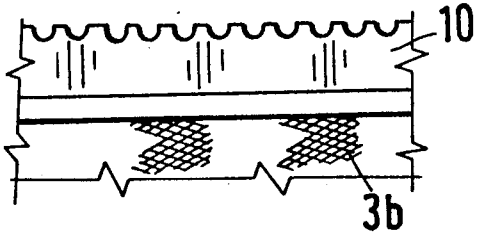

FIGS. 8*a*, 8*b* and 8*c* show various embodiments of the edges 10 of the overflow troughs 7. In contrast to a smooth edge, the comblike edge permits a uniform feeding of the liquid to the collecting electrode 3*b*.

Figure 9:
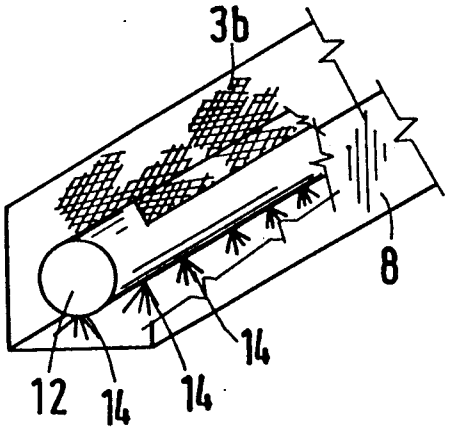
FIG. 9 is a fragmentary perspective view showing a collecting trough and the pipe extending along the bottom edge of each collecting electrode.

FIG. 9 shows a collecting trough 8 and a part of the pipe 12 at the bottom edge of a collecting electrode 3*b*. Part of the liquid which has been supplied flows through the openings 14 directly into the collecting trough 8 and flushes the latter. The unladen liquid and the laden liquid are jointly discharged from the collecting trough 8.

Figure 10:
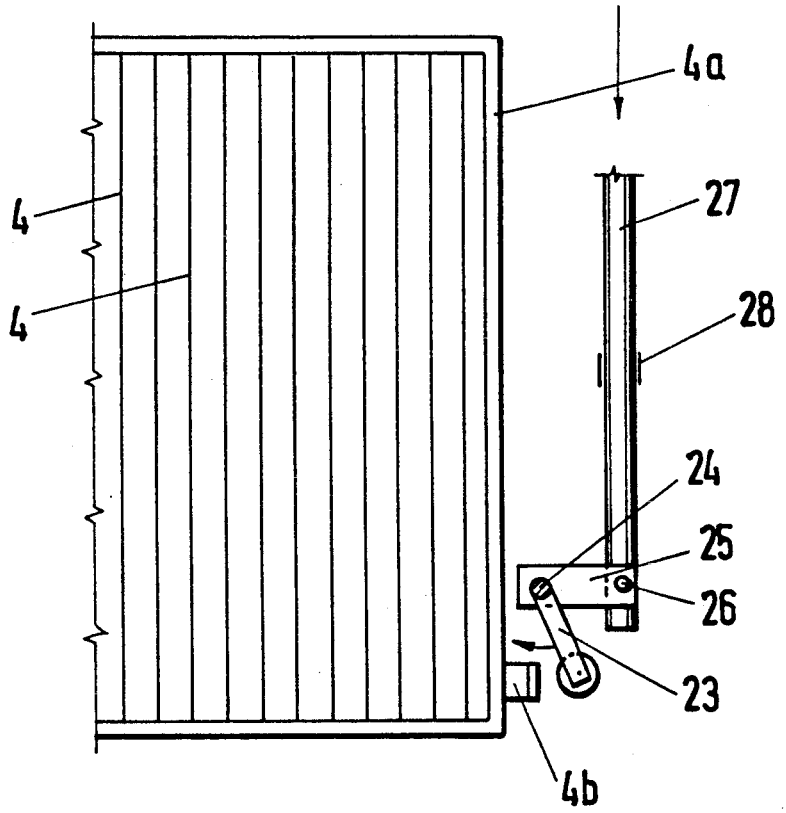
FIG. 10 shows corona electrodes of the second stage together with a rapping mechanism.

FIG. 10 is a diagrammatic illustration showing corona electrodes 4 of the second stage together with rapping means. The corona electrodes may consist, e.g., of metal wires, metal strips, or plastic fibers coated with electrically conductive material. Each corona electrode 4 extends vertically in and is fixed to a frame 4*a*, which belongs to hanger means. The frame 4*a* carries an anvil 4*b*. A drop hammer 23 is secured to a rotatably mounted shaft 24, to which a lifting lever 25 is secured, which is connected by a hinge 26 to a drawing rod 27, which is vertically slidably mounted in a bearing pin 28. Upon a displacement of the drawing rod 27 in the direction indicated by the arrow, the drop hammer 23 will strike on the anvil 4*b*.

Figure 11:
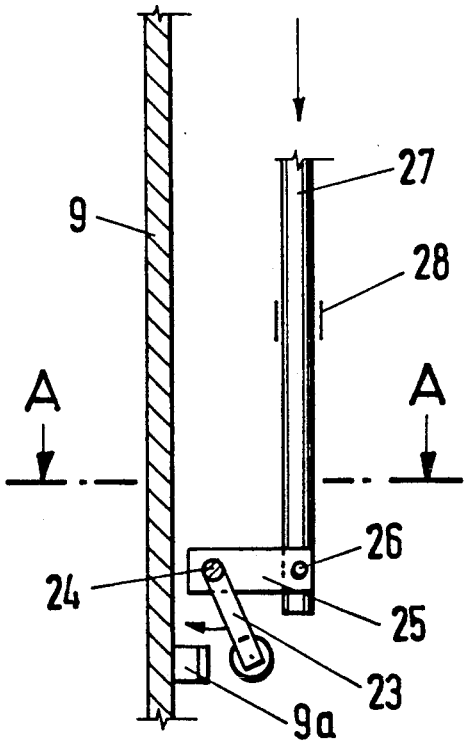
FIG. 11 is a sectional view showing the housing wall of the second stage together with a rapping mechanism.

FIG. 11 shows the housing wall 9 of the second stage together with rapping means, which are similar to those shown in FIG. 10. Upon a displacement of the drawing rod 27 in the direction indicated by the arrow, the drop hammer strikes on the anvil 9*a*, which is mounted directly on the housing wall 9.

Figure 12:
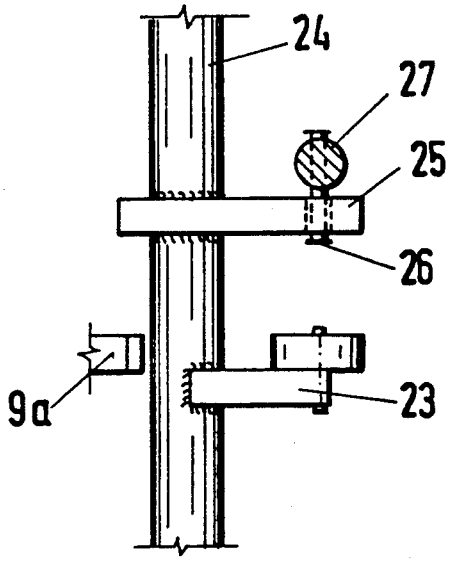
FIG. 12 is a horizontal sectional view taken on A—A in FIG. 2 and showing a rapping mechanism.

FIG. 12 is a top plan view showing the rapping means illustrated in FIG. 11. For the sake of clarity the shaft 24 is shown on a larger scale in FIG. 3. The drop hammer 23 is welded to the shaft 24. The lifting lever 25 is also welded to the shaft 24.

The rapping means illustrated in FIGS. 10 to 12 are disclosed merely by way of example. Different rapping means may also be employed.

Figure 13:
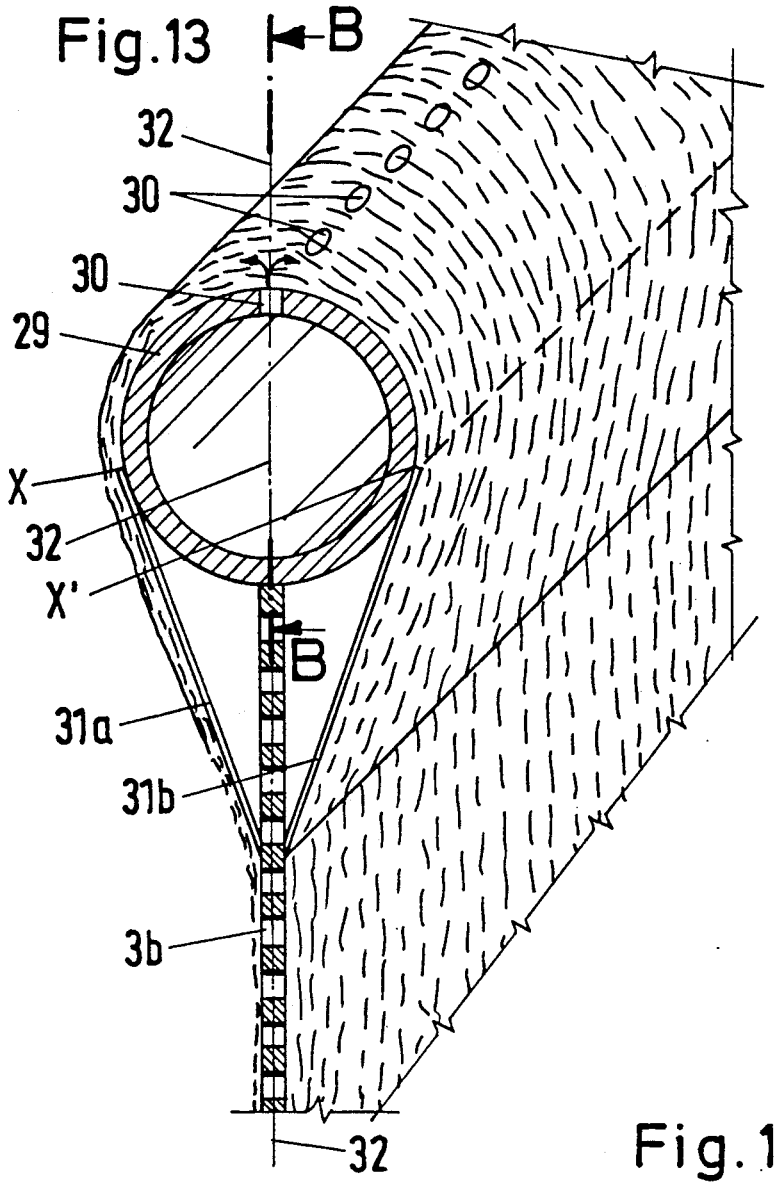
FIG. 13 is a sectional view showing the pipe which is joined to the collecting electrode.

FIG. 13 shows a pipe 29, which is joined to a collecting electrode 3*b* and which on that side which faces away from the collecting electrode 3*b* is formed with bores 30, which are disposed in the plane 32 of the collecting electrode 3*b*. Through said bores 30 the liquid is discharged out of the interior of the pipe. The pipe 29 is additionally connected to the collecting electrode 3*b* by the plates 31*a* and 31*b*. The plates 31*a* and 31*b* extend tangentially to the pipe 29 and are joined to the pipe 29 throughout the length of the pipe 29 at their side edges X and X'. The liquid which has been discharged from the bores 30 flows on the outside surface of the pipe 29 onto the plates 31*a* and 31*b* and forms a liquid film having a constant thickness on said plates 31*a* and 31*b*. From the plates 31*a* and 31*b* the liquid flows directly onto the surface of the collecting electrode 3*b* and flows down on the latter.

Figure 14:
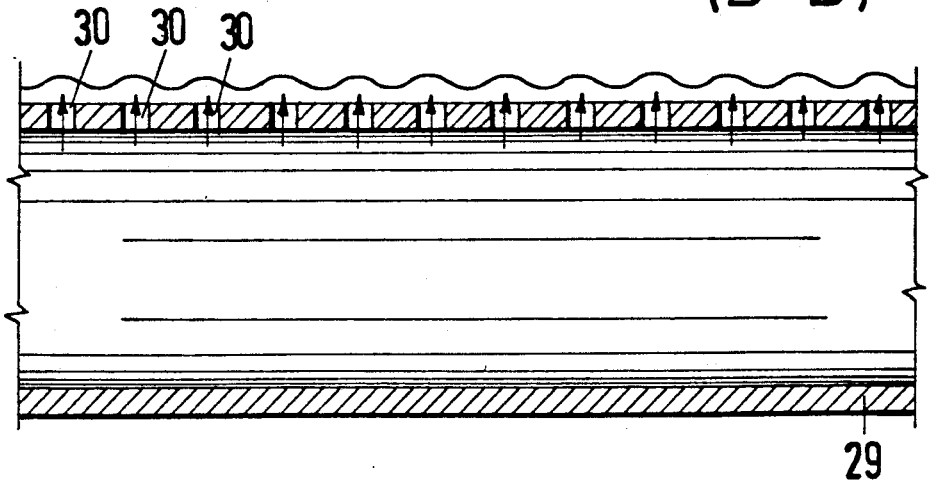
FIG. 14 is a sectional view taken on line B—B in FIG. 13 and showing the pipe.

FIG. 14 shows the pipe 29 in a sectional view taken on line B—B in FIG. 13 in the plane 32 of the collecting electrode 3*b*. Liquid is discharged outwardly through the bores 30 and forms on the outside surface of the pipe 29 a liquid film which has an almost constant thickness.

The invention will now be described more in detail with reference to an example.

Exhaust gas is produced by a sintering conveyor at a rate of 400,000 standard cubic meter ($sm^3$) per hour. The exhaust gas has a temperature of 120° C., a dew point temperature of 40° and a dust content of 1 $g/sm^3$.

The treatment in the multiple-field precipitator takes 6.2 s in the first stage 1 and 1.8 s in the second stage 2. The collecting surface area of the collecting electrodes 3*b* of the second stage 2 amounts to 23% of the total collecting surface area of the precipitator.

The throughput of the liquid with which the collecting electrodes 3*b* are wetted amounts to 300 $m^3/h$. A field strength in the range from 1.5 to 2.5 kV/cm was used and the measured residual content of dustlike materials amounted to 135 $mg/cm^3$ after the treatment in the first stage 1 and to 21 $mg/cm^3$ after the treatment in the second stage 2. After the second stage, the contents of dustlike inorganic substances of Class I (Cd, Hg, etc.) amounted to less than 0.2 $mg/sm^3$, the contents of dustlike inorganic substances of Class I (As, Ni, etc.) to less than 1.0 $mg/sm^3$ and the contents of dustlike inorganic substances of Class III (Pd, F, Sn, etc.) to less than 5.0 $mg/sm^3$. (Said classes correspond to the classification of dustlike inorganic substances contained in TA-Luft dated Feb. 27, 1986). The limits for vaporous and gaseous inorganic substances, particularly the limit of 500 $mg/sm^3$ for $SO_2$, were not exceeded in the experiment.

The temperature drop adjacent to the wetted collecting electrodes 3*b* amounted to about 25° C. As a result, the gas temperature was decreased to 95° C. and the dew-point temperature was raised to 44° C. The succeeding fan increased the gas temperature by 24° C. to 119° C. so that the gas entering the chimney at its bottom end had a temperature of 119° C. The relatively slight cooling of the exhaust gas which was effected in accordance with the invention in the second stage 2 resulted in a decrease by about 120 kW of the power requirement of the 3 megawatt fan in case of a gas inlet temperature of 95° C. and a dew point temperature of 44° C.

It will be understood that each of the elements described above, or two or more together, may also find a useful application in other types of processes and constructions differing from the types described above.

While the invention has been illustrated and described as embodied in a process and an apparatus for the electrostatic purification of dust- and pollutant-containing exhaust gases in multiple-field precipitators, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A process for electrostatic purification of dust- and pollutant-containing exhaust gases in multiple-field precipitator, comprising the steps of subjecting the exhaust gases in a first stage provided with discharge electrodes in direction of flow to an electrostatic purification under dry conditions in gas passages defined by collecting electrodes; discharging dry dust from the first stage; subsequently passing the exhaust gases in a second stage provided with discharge electrodes through one or more fields defined by liquid-wetted collecting electrodes which define gas passages; supplying a liquid in the second stage at the top ends of the collecting electrodes; collecting the liquid supplied in the second stage from the collecting electrodes under lower ends of the collecting electrodes; discharging the liquid from the precipitator; discharging pure gas from the second stage; and feeding substantially dry dust which is collected in the second stage to dust-receiving means.

2. A process as defined in claim 1, wherein a residence time of the gases in the second stage amounts to 60 to 80% of the entire residence time in the multiple-field precipitator.

3. A process as defined in claim 1, and further comprising the step of applying to the collecting electrodes a pulsed voltage having a pulse width in the range from 20 to 400 ms.

4. A process as defined in claim 1, wherein the liquid which is supplied to the second stage includes an alkaline aqueous solution having a pH value from 7 to 9.

5. A process as defined in claim 4, wherein the liquid which is supplied in the second stage also includes in addition a substance from the group consisting of NaOH, KOH, $Ca(OH)_2$ and their combinations.

6. A process as defined in claim 1, and further comprising the step of purging hot gas through nozzles into a dead space existing in the second stage between the collecting electrodes and a housing wall of the precipitator.

7. A process as defined in claim 6, and further comprising the step of discharging a part of a pure gas from the second stage and using the part as the hot gas.

8. A process as defined in claim 1, and further comprising the step of rapping a corona discharge system of the second stage.

9. A process as defined in claim 8, wherein said rapping includes rapping the corona discharge system once in intervals from 2 to 20 minutes.

10. A process as defined in claim 8, wherein said rapping includes consecutively rapping individual corona electrodes of the corona discharge system.

11. A process as defined in claim 8, wherein said rapping includes consecutively rapping individual hangers of the corona discharge system.

12. A process as defined in claim 1, and further comprising the step of rapping a housing wall of the second stage.

13. A process as defined in claim 12, wherein said rapping includes rapping the housing wall of the second stage in intervals from 20 to 120 minutes.

14. An apparatus for electrostatic purification of dust- and pollutant-containing exhaust gases, comprising means forming a first stage with an inlet, discharge electrodes and collecting electrodes for effecting an electrostatic purification under dry conditions and with a dry dust discharge; and means forming a second stage communicating with said first stage and provided with discharge electrodes, liquid-wetted collecting electrodes defining gas passages, a dry dust discharge, a liquid discharge, means for collecting liquid from said collecting electrodes and direction the liquid to said liquid discharge, and a pure gas outlet, said collecting electrodes of said second stage having a collecting surface area amounting to 20 to 45% of a total collecting surface area of all said collecting electrodes.

15. An apparatus as defined in claim 14, and further comprising a hot gas feeder provided in said second stage.

16. An apparatus as defined in claim 14, and further comprising an overflow trough provided at a top end of each of said collecting electrodes of said second stage, a collecting trough provided at a bottom end of each of said collecting electrodes of said second stage and forming said means for collecting liquid from said collecting electrodes and directing the liquid to said liquid discharge, each of said collecting electrodes of said second stage being secured to a bottom end of an associated one of said overflow troughs.

17. An apparatus as defined in claim 16, wherein at least one edge of each of said overflow troughs is a comb.

18. An apparatus as defined in claim 16, and further comprising a liquid feeder, each of said overflow troughs having a liquid distributing pipe which is formed with openings and connected to said liquid feeder.

19. An apparatus as defined in claim 16, and further comprising a plurality of liquid distributing pipes, each of said overflow troughs being connected to an associated one of said liquid distributing pipes.

20. An apparatus as defined in claim 14, and further comprising a pipe provided at a top end of each of said collecting electrodes of said second stage and directly joined to said collecting electrode and also provided with bores on a side which faces away from said collecting electrode, said bores being located in a plane of said collecting electrode, said pipe communicating with a source of liquid; and collecting troughs provided at bottom ends of respective ones of said collecting electrodes of said second stage and forming said means for collecting liquid from said collecting electrodes and directing the liquid to said liquid discharge.

21. An apparatus as defined in claim 20, wherein said bores are 8 to 12 mm in diameter.

22. An apparatus as defined in claim 20, wherein said bores are 20 to 40 mm spaced apart.

23. An apparatus as defined in claim 20, wherein said pipe is 60 to 140 mm in diameter.

24. An apparatus as defined in claim 20, and further comprising a plate which connects said pipe with said collecting electrode and extends in a longitudinal direction of said pipe.

25. An apparatus as defined in claim 24, wherein is connected to said pipe at an edge portion which is tangential to said pipe.

26. An apparatus as defined in claim 14, and further comprising a liquid feeder; and a pipe connected to said liquid feeder, each of said collecting electrodes of said second stage having edges which are connected to said pipe.

27. An apparatus as defined in claim 26, wherein said pipe has openings provided at a bottom edge of each of said collecting electrodes of said second stage.

* * * * *